US006239715B1

(12) United States Patent
Belton

(10) Patent No.: US 6,239,715 B1
(45) Date of Patent: May 29, 2001

(54) BEEPER SYSTEM

(76) Inventor: Karen L. Belton, 7527 Waters Edge Dr., Stone Mountain, GA (US) 30087

( * ) Notice: Subject to any disclaimer, the term of this patent is extended or adjusted under 35 U.S.C. 154(b) by 0 days.

(21) Appl. No.: 09/358,364

(22) Filed: Jul. 21, 1999

(51) Int. Cl.[7] ..... G08B 3/00

(52) U.S. Cl. ..... 340/691.3; 340/471; 340/505; 340/573.1

(58) Field of Search ..... 340/691.3, 573.1, 340/471, 505; 455/575, 227; 368/243, 245

(56) References Cited

U.S. PATENT DOCUMENTS

| | | | | |
|---|---|---|---|---|
| 4,307,460 | * | 12/1981 | Plolonsky | 368/74 |
| 4,786,902 | * | 11/1988 | Davis et al. | 340/852.44 |
| 4,899,135 | | 2/1990 | Ghahariiran | 340/573 |
| 4,961,575 | | 10/1990 | Perry | 273/1 E |
| 5,119,072 | | 6/1992 | Hemingway | 340/573 |
| 5,189,413 | * | 2/1993 | Gaskill et al. | 340/825.44 |
| 5,243,568 | * | 9/1993 | Burch et al. | 368/73 |
| 5,289,163 | | 2/1994 | Perez et al. | 340/539 |
| 5,349,340 | * | 9/1994 | Blumenthal | 340/321 |
| 5,357,254 | | 10/1994 | Kah, Jr. | 342/42 |
| 5,574,433 | * | 11/1996 | Bahcall | 340/574 |
| 5,627,520 | * | 5/1997 | Grubbs et al. | 340/572 |
| 5,689,240 | * | 11/1997 | Traxler | 340/573 |
| 5,907,522 | * | 5/1999 | Teodoridis et al. | 368/10 |
| 5,939,988 | * | 8/1999 | Neyhart | 340/573.4 |
| 5,952,931 | * | 9/1999 | Chotichanon et al. | 340/649 |
| 6,072,392 | * | 6/2000 | Henderson et al. | 340/539 |

* cited by examiner

*Primary Examiner*—Jeffery Hofsass
*Assistant Examiner*—Son Tang
(74) *Attorney, Agent, or Firm*—Joseph N. Breaux

(57) ABSTRACT

A beeper system that includes a beeper attached to a flexible band. The flexible band is attached to the child, such as around the wrist, waist or neck, to prevent the child from removing the beeper. The beeper is programmed to reach a no shut off mode wherein a speaker outputs an audible output of increasing loudness until the beeper is turned off by keyswitch controlled or kept by the supervising adult. The keyswitch is also used to disconnect the flexible band to allow removal of the beeper. A wearer silence button is provided to allow for a warning period before the no shut off mode is reached.

2 Claims, 4 Drawing Sheets

BEEPER SYSTEM

TECHNICAL FIELD

The present invention relates to beepers and more particularly to a beeper system that includes a beeper attached to a locking flexible band; the locking flexible band being constructed from a flexible material and including a locking end having a beeper housing insertion portion provided with a locking bolt aperture; the beeper including a beeper housing and a beeper circuit; the beeper housing having the beeper circuit provided therein, a band end receiving cavity formed into a sidewall thereof sized to receive a beeper housing insertion portion of a locking end of the flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof; the beeper circuit including a programmable beeper controller having a radio input in connection with a radio receiver including a radio antenna, a display output in connection with the digital display, a speaker output in connection with a speaker, a silence input in connection with the wearer speaker silence button, and a keyswitch input in connection with the on/off keyswitch and band lock; the keyswitch and band lock including a two position electrical switch positionable between a closed and an open position with a key wherein positioning the electrical switch into the closed position causes a J-shaped mechanical locking bolt to move upward from an unlocked position to a locked position and positioning the electrical switch into the open position causes the J-shaped mechanical locking bolt to move downward from a locked position to an unlocked position; the speaker being positioned within the housing behind the speaker grate; the beeper controller circuit being programmed to activate the digital display and the speaker when an activation signal is received by the radio receiver, to temporarily allow a wearer to silence the speaker by depressing the wearer speaker silence button a fixed number of times, to reactivate the speaker after being deactivated by the depressing of the wearer speaker silence button after a predetermined time interval, to, once the last predetermined time interval has elapsed, finally activate the speaker at an increasing sound level that increases from a normal level to a high level over an elapsed period of time, and to only deactivate the speaker when an off input is received from the on/off keyswitch and band lock.

BACKGROUND ART

It is often difficult to get a child to return home at a predetermined time or when told over a phone or the like. It would be desirable therefore, to have a beeper system that could be attached to the child, such as around the wrist, waist or neck, by a band preventing removal of the beeper and that included a beeper which reached a no shut off mode wherein a speaker outputs an audible output of increasing loudness until the beeper is turned off by keyswitch controlled or kept by the supervising adult. To provide the child with a warning period a wearer silence button can be provided on the beeper.

GENERAL SUMMARY DISCUSSION OF INVENTION

It is thus an object of the invention to provide a beeper system that includes a beeper attached to a locking flexible band; the locking flexible band being constructed from a flexible material and including a locking end having a beeper housing insertion portion provided with a locking bolt aperture; the beeper including a beeper housing and a beeper circuit; the beeper housing having the beeper circuit provided therein, a band end receiving cavity formed into a sidewall thereof sized to receive a beeper housing insertion portion of a locking end of the flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof; the beeper circuit including a programmable beeper controller having a radio input in connection with a radio receiver including a radio antenna, a display output in connection with the digital display, a speaker output in connection with a speaker, a silence input in connection with the wearer speaker silence button, and a keyswitch input in connection with the on/off keyswitch and band lock; the keyswitch and band lock including a two position electrical switch positionable between a closed and an open position with a key wherein positioning the electrical switch into the closed position causes a J-shaped mechanical locking bolt to move upward from an unlocked position to a locked position and positioning the electrical switch into the open position causes the J-shaped mechanical locking bolt to move downward from a locked position to an unlocked position; the speaker being positioned within the housing behind the speaker grate; the beeper controller circuit being programmed to activate the digital display and the speaker when an activation signal is received by the radio receiver, to temporarily allow a wearer to silence the speaker by depressing the wearer speaker silence button a fixed number of times, to reactivate the speaker after being deactivated by the depressing of the wearer speaker silence button after a predetermined time interval, to, once the last predetermined time interval has elapsed, finally activate the speaker at an increasing sound level that increases from a normal level to a high level over an elapsed period of time, and to only deactivate the speaker when an off input is received from the on/off keyswitch and band lock.

Accordingly, a beeper system is provided. The beeper system includes a beeper attached to a locking flexible band; the locking flexible band being constructed from a flexible material and including a locking end having a beeper housing insertion portion provided with a locking bolt aperture; the beeper including a beeper housing and a beeper circuit; the beeper housing having the beeper circuit provided therein, a band end receiving cavity formed into a sidewall thereof sized to receive a beeper housing insertion portion of a locking end of the flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof; the beeper circuit including a programmable beeper controller having a radio input in connection with a radio receiver including a radio antenna, a display output in connection with the digital display, a speaker output in connection with a speaker, a silence input in connection with the wearer speaker silence button, and a keyswitch input in connection with the on/off keyswitch and band lock; the keyswitch and band lock including a two position electrical switch positionable between a closed and an open position with a key wherein positioning the electrical switch into the closed position causes a J-shaped mechanical locking bolt to move upward from an unlocked position to a locked position and positioning the electrical switch into the open position causes the J-shaped mechanical locking bolt to move downward from a locked position to an unlocked position; the speaker being positioned within the housing behind the speaker grate; the beeper controller circuit being programmed to activate the digital display and the speaker when an activation signal is received by the radio receiver, to temporarily allow a wearer to silence the speaker by depressing the wearer speaker silence button a fixed number of times, to reactivate the speaker after being deactivated by the depressing of the wearer speaker silence button after a predetermined time interval, to, once the last predetermined time interval has elapsed, finally activate the speaker at an increasing sound level that increases from a normal level to a high level over an elapsed period of time, and to only deactivate the speaker when an off input is received from the on/off keyswitch and band lock.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
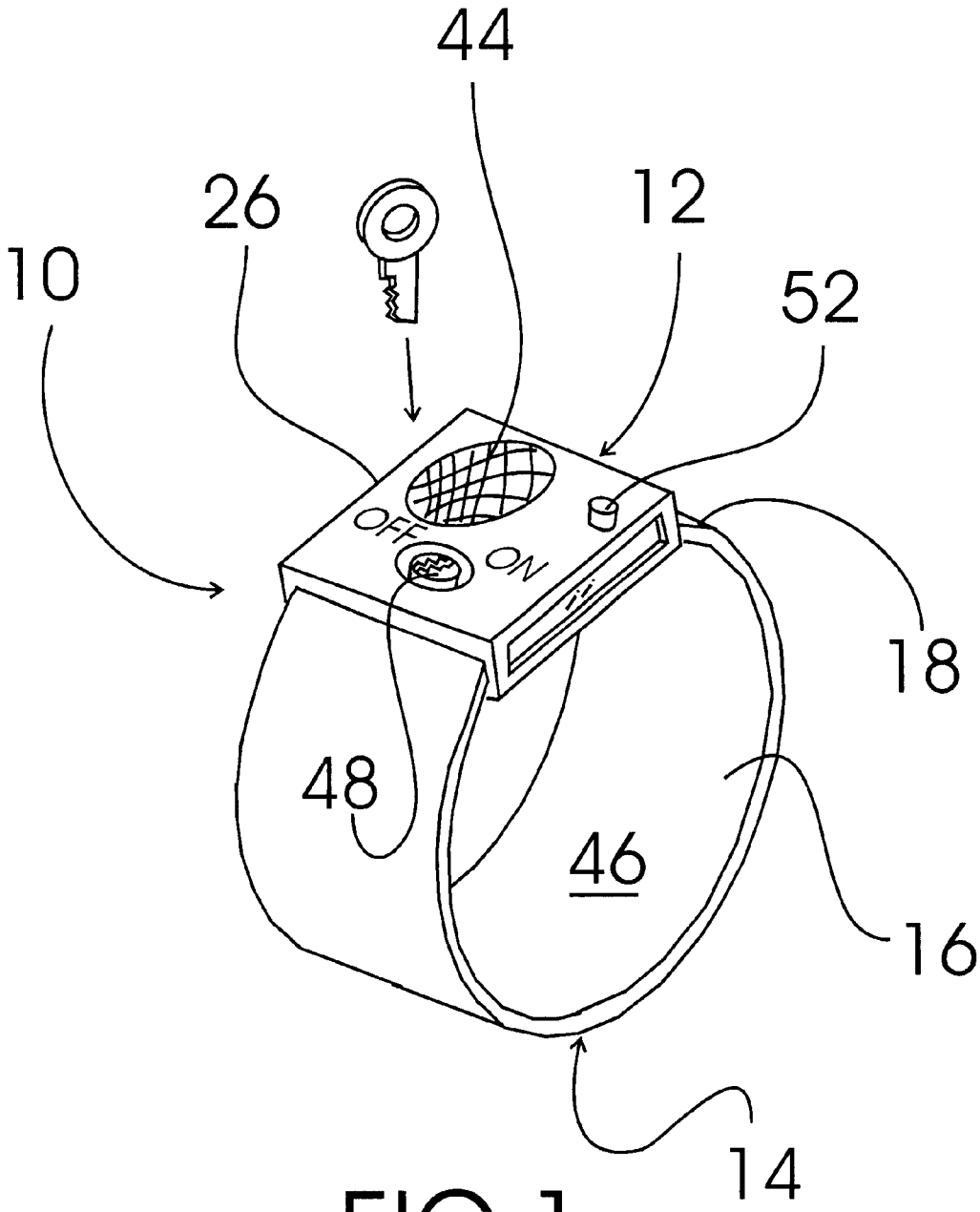
FIG. 1 is a perspective view of an exemplary embodiment of the beeper system of the present invention showing the beeper housing of the beeper in connection with the locking flexible wrist band; the locking flexible wrist band being constructed from a flexible material and including a locking end having a beeper housing insertion portion provided with a locking bolt aperture; the beeper housing having a beeper circuit provided therein, a band end receiving cavity sized to receive the beeper housing insertion portion of the locking end of the flexible wrist band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof.

FIG. 1 shows an exemplary embodiment of the beeper system of the present invention generally designated 10. Beeper system 10 includes a beeper, generally designated 12, in connection with a locking flexible band, generally designated 14.

Figure 3:
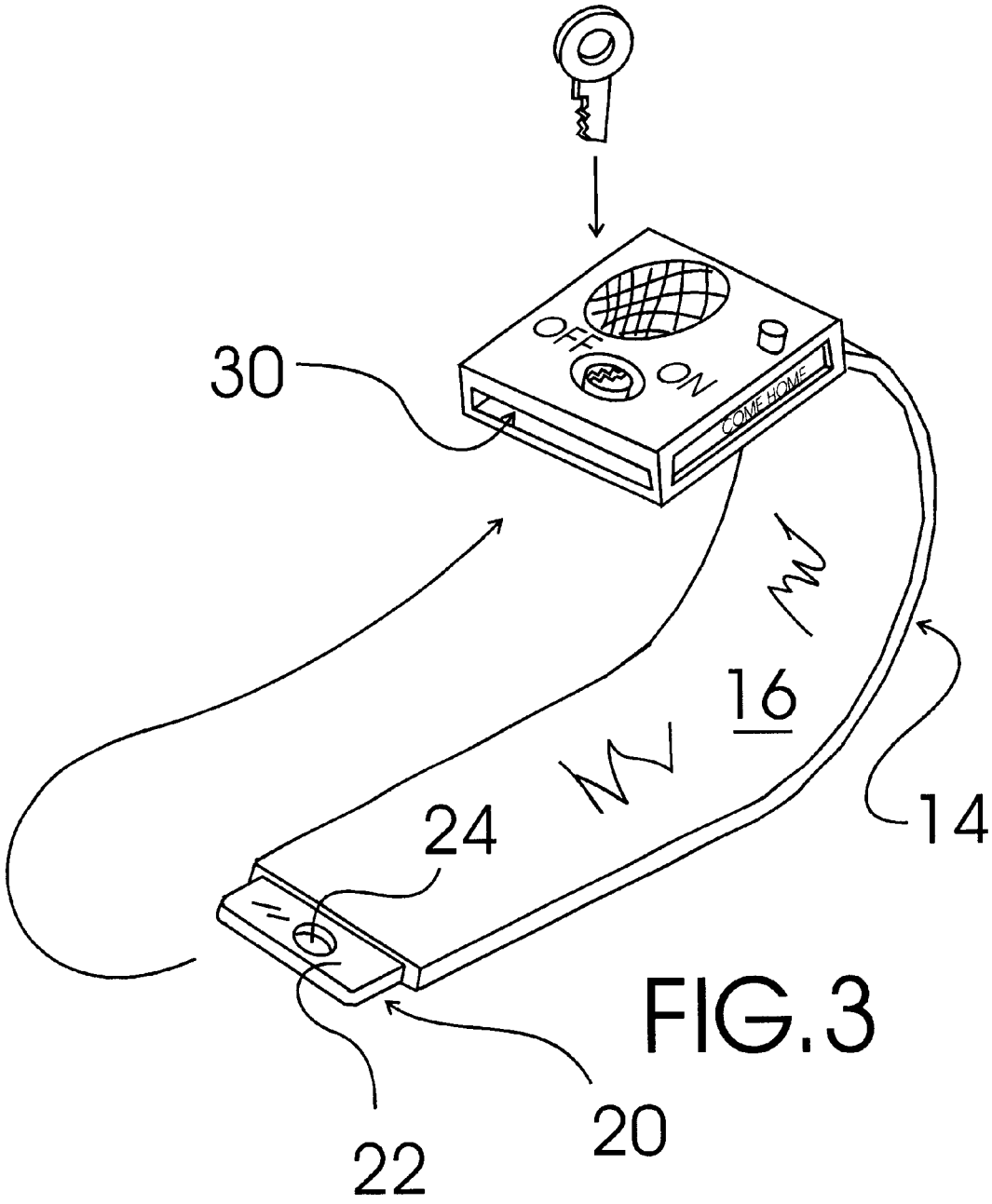
FIG. 3 is a perspective view of the locking end of the flexible band disconnected from the beeper housing showing the locking bolt aperture provided through the beeper housing insertion portion of the flexible band and the band end receiving cavity of the beeper housing.

Locking flexible band 14 is constructed from a flexible strip 16 of metal fixedly attached at a fixed end 18 to beeper 12 and referring now to FIG. 3, includes a locking end, generally designated 20, having a beeper housing insertion portion 22 provided with a locking bolt aperture 24.

Figure 2:
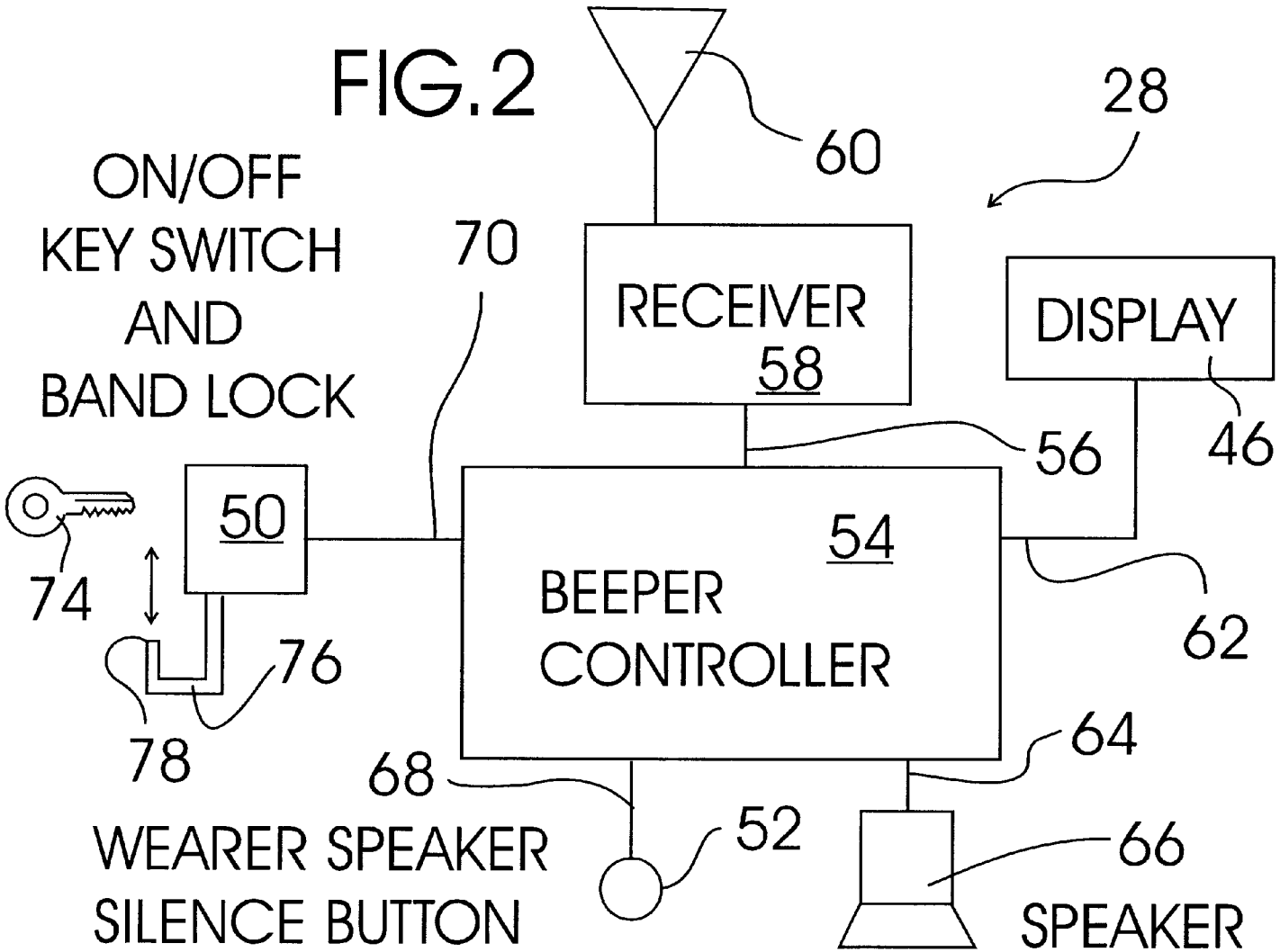
FIG. 2 is a schematic diagram of an exemplary beeper circuit including a programmable beeper controller having a radio input in connection with a radio receiver including a radio antenna, a display output in connection with the digital display, a speaker output in connection with a speaker, a silence input in connection with the wearer speaker silence button, and a keyswitch input in connection with the on/off keyswitch and band lock; the keyswitch and band lock including a two position electrical switch positionable between a closed and an open position with a key wherein positioning the electrical switch into the closed position causes a J-shaped mechanical locking bolt to move upward from an unlocked position to a locked position and positioning the electrical switch into the open position causes the J-shaped mechanical locking bolt to move downward from a locked position to an unlocked position; the speaker being positioned within the housing behind the speaker grate; the beeper controller circuit being programmed to activate the digital display and the speaker when an activation signal is received by the radio receiver, to temporarily allow a wearer to silence the speaker by depressing the wearer speaker silence button a fixed number of times, to reactivate the speaker after being deactivated by the depressing of the wearer speaker silence button after a predetermined time interval, to, once the last predetermined time interval has elapsed, finally activate the speaker at an increasing sound level that increases from a normal level to a high level over an elapsed period of time, and to only deactivate the speaker when an off input is received from the on/off keyswitch and band lock.
Figure 4:
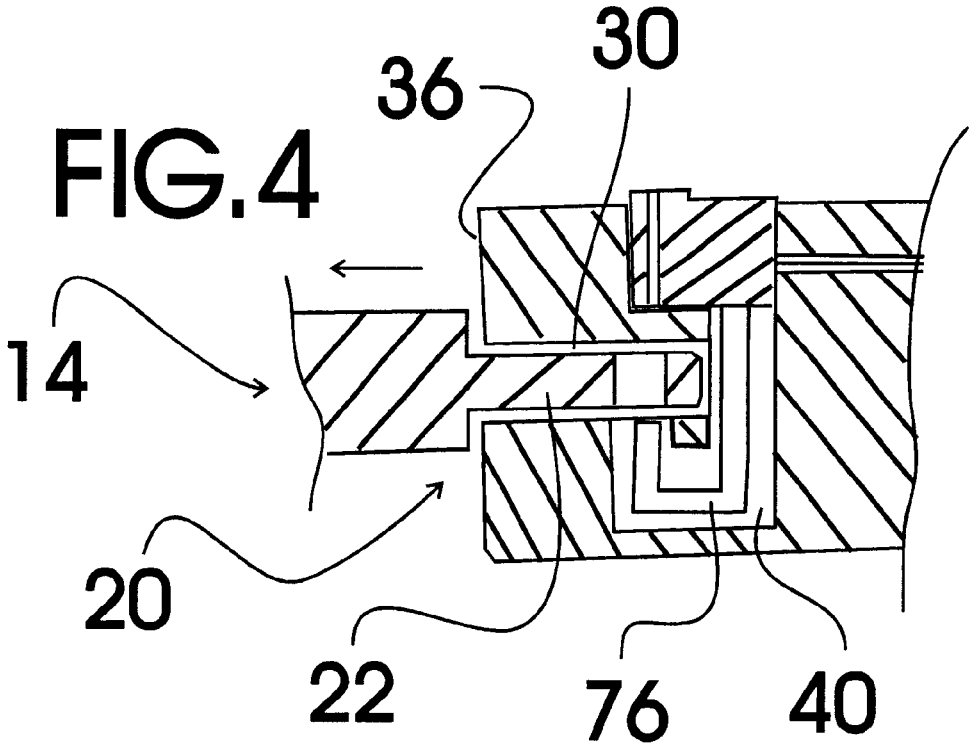
FIG. 4 is a cross section view showing the keyswitch and band lock in the "open"/"off" position with the tip end of the J-shaped mechanical locking bolt moved down out of the locking bolt aperture of the insertion portion of the flexible locking wrist band allowing the insertion portion to be freely inserted and removed from the band end receiving cavity of the beeper housing.
Figure 5:
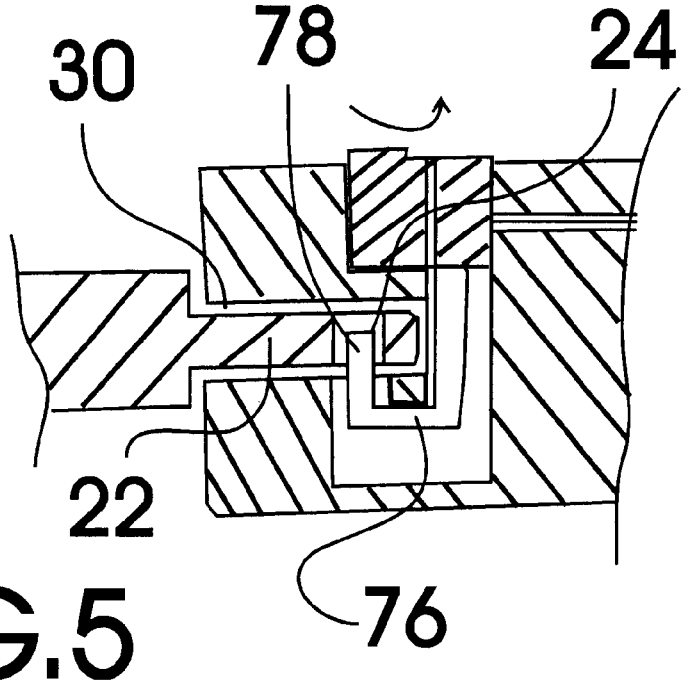
FIG. 5 is a cross section view showing the keyswitch and band lock in the "closed"/"on" position with the tip end of the J-shaped mechanical locking bolt moved upward into the locking bolt aperture of the insertion portion of the flexible locking wrist band preventing the insertion portion from being removed from the band end receiving cavity of the beeper housing.

Referring back to FIG. 1, beeper 12 includes a rigid plastic beeper housing, generally designated 26, and a beeper circuit, generally designated 28 (FIG. 2). Beeper housing 26 has beeper circuit 28 (FIG. 2) housed therein; a band end receiving cavity, generally designated 30 (FIGS. 3,4,5), formed, referring to FIG. 4) into a sidewall thereof 36 thereof that is sized to receive beeper housing insertion portion 22 of locking end 20 of flexible band 14 and having a locking bolt movement portion 40 in connection therewith; referring back FIG. 1, a speaker grate 44 on an exterior surface thereof; a digital display 46 on an exterior surface, a key receiving portion 48 of an on/off keyswitch and band lock assembly 50 (FIG. 2) extending through an exterior surface thereof; and a wearer speaker silence button 52 extending through an exterior surface thereof.

Referring to FIG. 2, beeper circuit 28 includes a programmable beeper controller 54 having a radio input 56 in connection with a radio receiver 58 including a radio antenna 60; a display output 62 in connection with the digital display 46; a speaker output 64 in connection with a speaker 66; a silence input 68 in connection with the wearer speaker silence button 52; and a keyswitch input 70 in connection with the on/off keyswitch and band lock 50. Keyswitch and band lock 50 includes a two position electrical switch positionable between a closed and an open position with a key 74 wherein positioning the electrical switch into the closed position causes a J-shaped mechanical locking bolt 76 to move upward from an unlocked position (FIG. 4) to, referring to FIG. 5, a locked position with a tip end 78 positioned into locking bolt aperture 24 (see also FIG. 3) of insertion portion 22 preventing insertion portion 22 from being removed from band end receiving cavity 30. In use flexible band 14 is attached around the wrist of a wearer as previously described.

Referring generally now to FIGS. 1–5, speaker 66 is positioned within beeper housing 26 behind speaker grate 44. Beeper controller circuit 28 is programmed to a) activate digital display 46 and speaker 66 when an activation signal is received by radio receiver 58 via antenna 60; to b) temporarily allow a wearer to silence the speaker 66 by depressing the wearer speaker silence button 52 a total of three times; to c) reactivate the speaker 66 after being deactivated by the depressing of wearer speaker silence button 52 after a tem minute time interval; to d) after the third ten minute time interval has elapsed, finally activate the speaker 66 at an increasing sound level that increases from a normal level to a high level over an elapsed period of time; and to e) only deactivate the speaker 66 when an off input is received from the on/off keyswitch and band lock 50.

It can be seen from the preceding description that a beeper system has been provided that includes a beeper attached to a locking flexible band; the locking flexible band being constructed from a flexible material and including a locking end having a beeper housing insertion portion provided with a locking bolt aperture; the beeper including a beeper housing and a beeper circuit; the beeper housing having the beeper circuit provided therein, a band end receiving cavity formed into a sidewall thereof sized to receive a beeper housing insertion portion of a locking end of the flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof; the beeper circuit including a programmable beeper controller having a radio input in connection with a radio receiver including a radio antenna, a display output in connection with the digital display, a speaker output in connection with a speaker, a silence input in connection with the wearer speaker silence button, and a keyswitch input in connection with the on/off keyswitch and band lock; the keyswitch and band lock including a two position electrical switch positionable between a closed and an open position with a key wherein positioning the electrical switch into the closed position causes a J-shaped mechanical locking bolt to move upward from an unlocked position to a locked position and positioning the electrical switch into the open position causes the J-shaped mechanical locking bolt to move downward from a locked position to an unlocked position; the speaker being positioned within the housing behind the speaker grate; the beeper controller circuit being programmed to activate the digital display and the speaker when an activation signal is received by the radio receiver, to temporarily allow a wearer to silence the speaker by depressing the wearer speaker silence button a fixed number of times, to reactivate the speaker after being deactivated by the depressing of the wearer speaker silence button after a predetermined time interval, to, once the last predetermined time interval has elapsed, finally activate the speaker at an increasing sound level that increases from a normal level to a high level over an elapsed period of time, and to only deactivate the speaker when an off input is received from the on/off keyswitch and band lock. Although a wrist band is shown in the exemplary embodiment, a neck sized band or waist sized band could also be used.

It is noted that the embodiment of the beeper system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A beeper system comprising:

a locking flexible band; and a beeper attached to said locking flexible band;

said locking flexible band being constructed from a flexible material and including a locking end having a beeper housing insertion portion provided with a locking bolt aperture;

said beeper including a beeper housing and a beeper circuit;

said beeper housing having said beeper circuit provided therein, a band end receiving cavity formed into a sidewall thereof sized to receive a beeper housing insertion portion of a locking end of said flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof;

said beeper circuit including a programmable beeper controller having a radio input in connection with a radio receiver including a radio antenna, a display output in connection with said digital display, a speaker output in connection with a speaker, a silence input in connection with said wearer speaker silence button, and a keyswitch input in connection with said on/off keyswitch and band lock;

said keyswitch and band lock including a two position electrical switch positionable between a closed and an open position with a key wherein positioning said electrical switch into said closed position causes a J-shaped mechanical locking bolt to move upward from an unlocked position to a locked position and positioning said electrical switch into said open position causes said J-shaped mechanical locking bolt to move downward from a locked position to an unlocked position;

said speaker being positioned within said housing behind said speaker grate;

said beeper controller circuit being programmed to activate said digital display and said speaker when an activation signal is received by said radio receiver, to temporarily allow a wearer to silence said speaker by depressing said wearer speaker silence button a fixed number of times, to reactivate said speaker after being deactivated by said depressing of said wearer speaker silence button after a predetermined time interval, to, once said last predetermined time interval has elapsed, finally activate said speaker at an increasing sound level that increases from a normal level to a high level over an elapsed period of time, and to only deactivate said speaker when an off input is received from said on/off keyswitch and band lock.

2. A method of urging a child to come to an appointed location comprising the steps of:

a) providing a beeper system comprising:

a locking flexible band; and a beeper attached to said locking flexible band;

said locking flexible band being constructed from a flexible material and including a locking end having a beeper housing insertion portion provided with a locking bolt aperture;

said beeper including a beeper housing and a beeper circuit;

said beeper housing having said beeper circuit provided therein, a band end receiving cavity formed into a sidewall thereof sized to receive a beeper housing insertion portion of a locking end of said flexible band and having a locking bolt movement portion in connection therewith, a speaker grate on an exterior surface thereof, a digital display on an exterior surface, a key receiving portion of an on/off keyswitch and band lock assembly extending through an exterior surface thereof, and a wearer speaker silence button extending through an exterior surface thereof;

said beeper circuit including a programmable beeper controller having a radio input in connection with a radio receiver including a radio antenna, a display output in connection with said digital display, a speaker output in connection with a speaker, a silence input in connection with said wearer speaker silence button, and a keyswitch input in connection with said on/off keyswitch and band lock;

said keyswitch and band lock including a two position electrical switch positionable between a closed and an open position with a key wherein positioning said electrical switch into said closed position causes a J-shaped mechanical locking bolt to move upward from an unlocked position to a locked position and positioning said electrical switch into said open position causes said J-shaped mechanical locking bolt to move downward from a locked position to an unlocked position;

said speaker being positioned within said housing behind said speaker grate;

said beeper controller circuit being programmed to activate said digital display and said speaker when an activation signal is received by said radio receiver, to temporarily allow a wearer to silence said speaker by depressing said wearer speaker silence button a fixed number of times, to reactivate said speaker after being deactivated by said depressing of said wearer speaker silence button after a predetermined time interval, to, once said last predetermined time interval has elapsed, finally activate said speaker at an increasing sound level that increases from a normal level to a high level over an elapsed period of time, and to only deactivate said speaker when an off input is received from said on/off keyswitch and band lock;

b) affixing and locking said lockable band around the wrist of a child to be urged to the appointed location; and c) transmitting an activation signal to the radio receiver of the beeper circuit; whereby the child is urged to the appointed location to have the speaker silenced.

* * * * *